United States Patent [19]

Luczak et al.

[11] 4,342,445

[45] Aug. 3, 1982

[54] SELF-ALIGNING TRUNNION BRACKET FOR METALLURGICAL VESSELS

[75] Inventors: Joseph J. Luczak, New Castle; Rashed N. Nagati, Mars, both of Pa.

[73] Assignee: Pennsylvania Engineering Corp., Pittsburgh, Pa.

[21] Appl. No.: 202,941

[22] Filed: Nov. 3, 1980

[51] Int. Cl.[3] ..... C21C 5/50

[52] U.S. Cl. ..... 266/296

[58] Field of Search ..... 266/243–246

[56] References Cited

U.S. PATENT DOCUMENTS

| | | | |
|---|---|---|---|
| 3,191,921 | 6/1965 | Johnsen | 266/46 |
| 3,561,744 | 2/1971 | Altman | 266/46 |
| 3,756,583 | 9/1973 | Nagati | 266/46 |
| 4,191,364 | 3/1980 | Montgomery et al. | 266/46 |

*Primary Examiner*—G. O. Peters

*Attorney, Agent, or Firm*—Fred Wiviott

[57] ABSTRACT

A metallurgical vessel supported on a trunnion ring includes a plurality of bracket assemblies, each having a bracket plate which slidably engages a shoe for movement during vessel expansion and contraction. A replaceable wear shim is interposed between the sliding shoe and the upper surface of the vessel trunnion ring. A gib assembly is mounted adjacent the lateral ends of each sliding shoe. Each gib assembly includes a gib block secured to the trunnion ring for clamping engagement with the wear shim, the sliding shoe, and the bracket plate. Tapered spacers are interposed between each gib block, bracket plate and sliding shoe to accommodate relative movement of the block and the bracket plate during vessel expansion and contraction. The vessel may also include a second plurality of bracket assemblies disposed adjacent the lower surface of the trunnion ring and engaging a lower sliding shoe. Laterally disposed retaining blocks and spacer bars confine the lower sliding shoe and support the vessel during tilting.

11 Claims, 8 Drawing Figures

SELF-ALIGNING TRUNNION BRACKET FOR METALLURGICAL VESSELS

BACKGROUND OF THE INVENTION

This invention relates to means for mounting a metallurgical vessel on a supporting trunnion ring.

Metallurgical converters such as BOF vessels, Q-BOP vessels and AOD vessels generally comprise a pear-shaped vessel which is mounted on a trunnion ring for being pivoted about a horizontal axis. Such vessels normally include a plurality of brackets affixed to their outer surfaces and adapted to engage the supporting trunnion ring. The brackets are normally releasably secured to the trunnion ring by means of a pair of gibs affixed to the trunnion ring adjacent the lateral edges of the support bracket. A plurality of shims are also normally provided for being wedged between the gibs and their associated brackets for providing a rigid connection therebetween. One such prior art assembly is described in U.S. Pat. No. 3,561,744 while another such prior art assembly is described in U.S. Pat. No. 4,191,364.

While these prior art vessel mounting assemblies have provided satisfactory means for securing a metallurgical vessel to a trunnion ring, it has been difficult to prevent distortion or breakage of the mounting hardware which may tend to occur due to vessel shell deformation. It has also been difficult to prevent wear of the trunnion ring surface and to effect rapid, inexpensive replacement of the wearing surfaces.

SUMMARY OF THE INVENTION

A self-aligning trunnion bracket includes a plurality of brackets affixed to a metallurgical vessel. Each bracket has a pair of arcuate edges engaging a sliding shoe. A replaceable wear shim is interposed between the vessel trunnion support and the sliding shoe. Each bracket with its associated shoe and wear shim is slidably secured to the trunnion support with a gib block. A pair of tapered spacers is mounted between the shoe, the bracket and the gib block for accommodating relative movement of the bracket plate and the sliding shoe with respect to the gib block.

It is an object of the invention to provide a new and improved means for securing a metallurgical vessel to a trunnion ring.

Another object of the invention is to provide a metallurgical vessel mounting assembly which prevents damage to the vessel mounting hardware due to vessel shell deformation.

Yet another object of the invention is to provide a metallurgical vessel mounting assembly in which parts subject to wear may be easily removed for repair and replacement.

Another object of the invention is to provide a metallurgical vessel mounting assembly which is self-aligning upon deformation of the vessel shell.

These and other objects and advantages of the present invention will become more apparent from the detailed description thereof taken with the accompanying drawings.

In general terms, the invention comprises a metallurgical vessel having a trunnion support at least partially surrounding said vessel. A plurality of brackets are affixed to the vessel in spaced-apart relation for supporting said vessel on the trunnion support and each bracket has a pair of arcuate edges extending generally away from said vessel. A retainer is provided for each bracket and includes gib means affixed to the trunnion support and being positioned to prevent displacement of the bracket means away from the trunnion support and shoe means disposed between the gib means and the lateral edges of the bracket means. The shoe means also has a pair of surfaces complimentary to and disposed adjacent the arcuate edges on said bracket to permit angular reorientation of said bracket means relative to the gib means should said vessel become distorted in operation.

DETAILED DESCRIPTION OF THE PREFERRED EMBODIMENT

Figure 1:
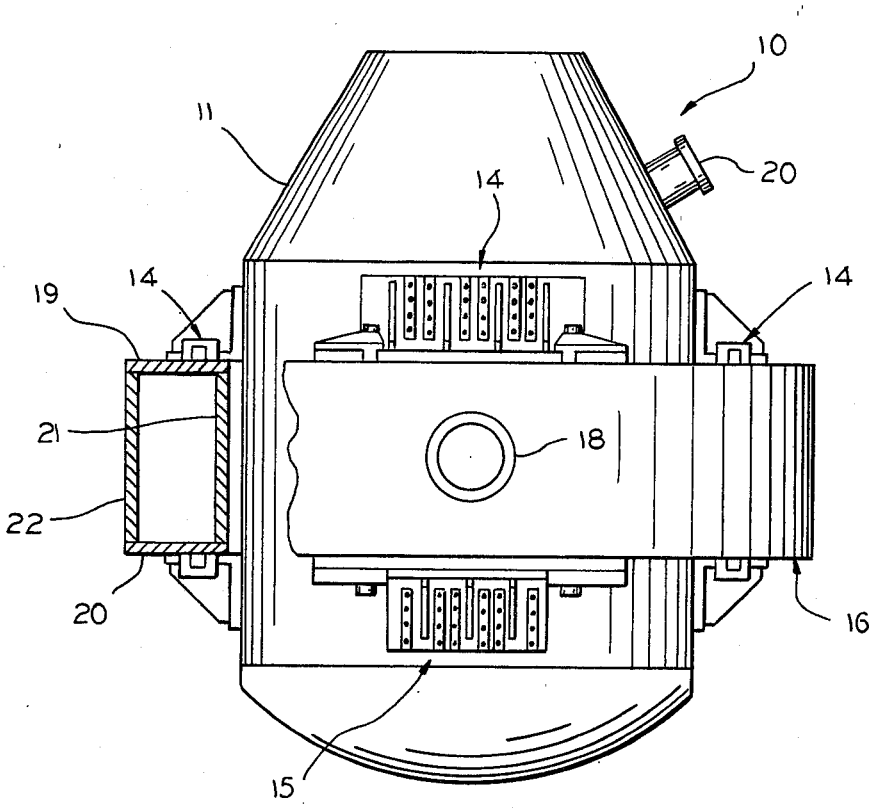
FIG. 1 is a side elevational view, with a portion broken away, of a metallurgical vessel with which the trunnion bracket of the present invention is usable.

The invention will be illustrated in connection with a vessel 10, shown in FIGS. 1 and 2 to be generally pear-shaped and open at its upper end. Vessel 10 includes a metallic shell 11 and a refractory lining 12. A plurality of upper and lower support assemblies 14 and 15 secure vessel 10 to a trunnion ring 16. A trunnion 18 extends from each of the opposite sides of trunnion ring 16 and each is supported in a well known manner on bearing structures (not shown). One of the trunnions 18 is also coupled to a suitable drive mechanism (not shown) for tilting the vessel 10 to various positions to permit charging, de-slagging, sampling, temperature measurement, or discharge of hot metal through a pouring spout 20.

Figure 2:
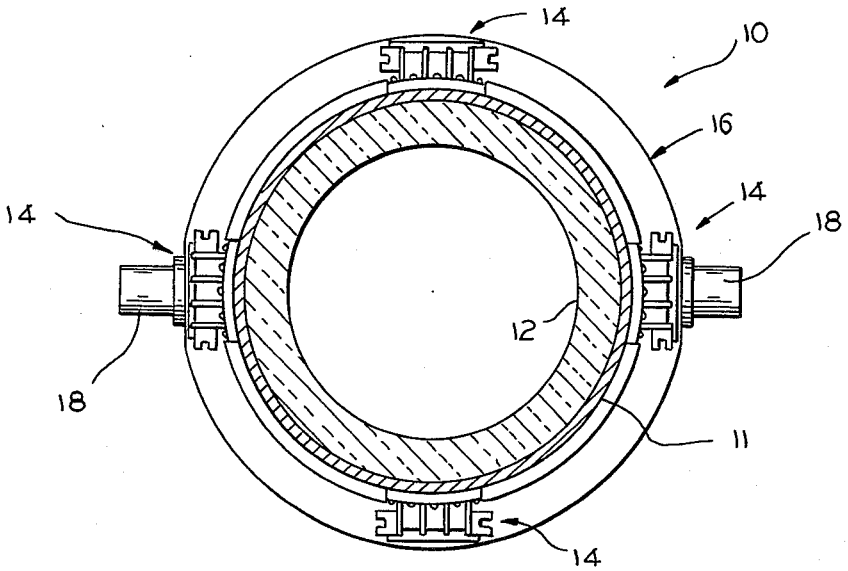
FIG. 2 is a top plan view, partly in section, of the vessel illustrated in FIG. 1.

While the preferred embodiment of the invention is shown in FIGS. 1 and 2 to include four upper support assemblies 14 and two lower support assemblies 15, the actual number of each will be governed by the size and weight of the vessel 10 being supported. Preferably the upper and lower assemblies are spaced equiangularly around the vessel, which in the case of four assemblies, the displacement would be at a radial angle of substantially 90°.

The trunnion ring 16 is comprised of upper and lower flanges 19 and 20, and inner and outer wrappers 21 and 22, which are joined to form the generally hollow, annular assembly through which cooling water may be circulated in a manner well known in the art.

Figures 3, 5, 6:
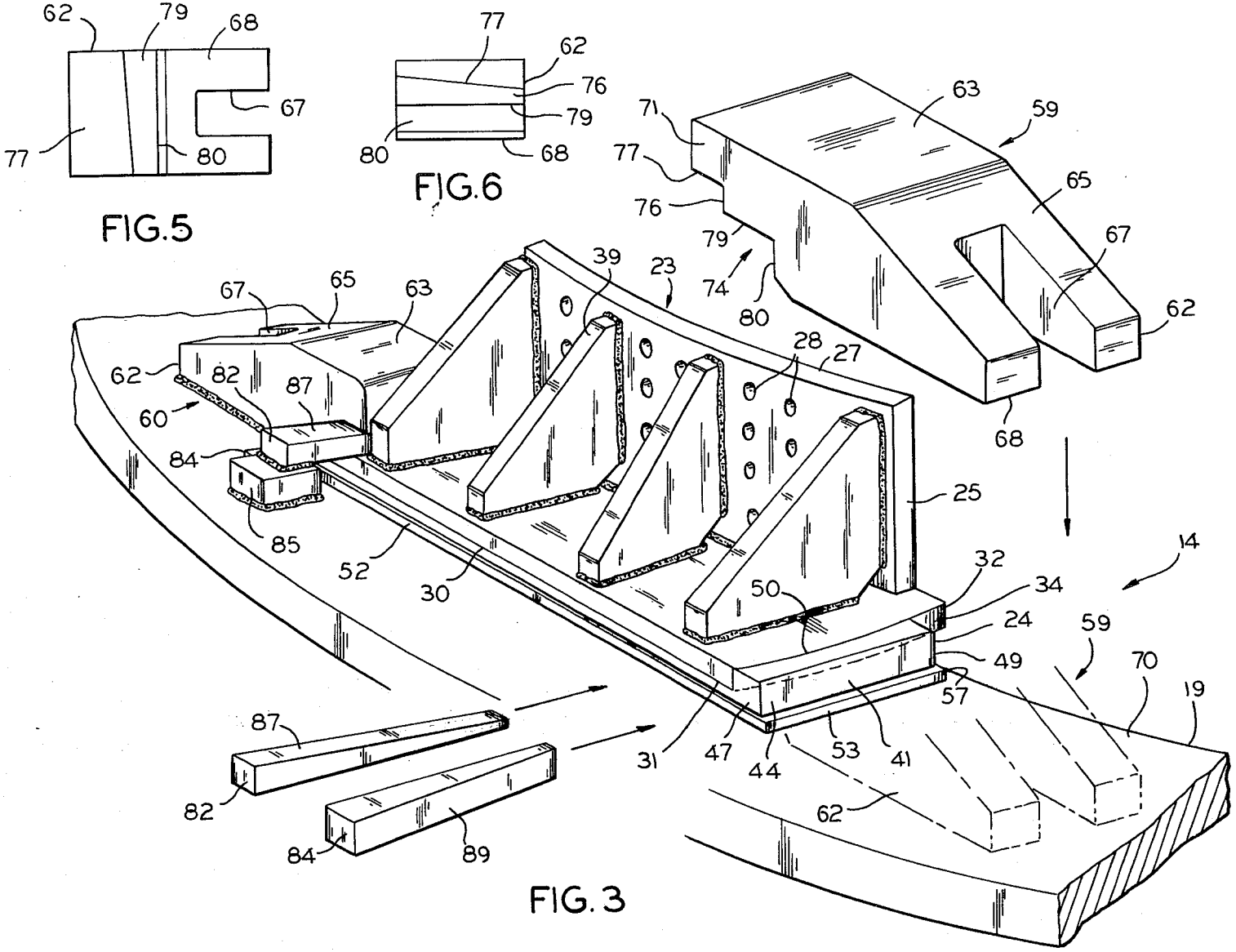
FIG. 3 is an exploded perspective view of the top portion of the trunnion bracket according to the preferred embodiment of the invention.
FIG. 5 is an end elevation view of the portion of the trunnion bracket shown in FIG. 4.
FIG. 6 is a top plan view of the trunnion bracket of FIG. 3.
Figure 4:
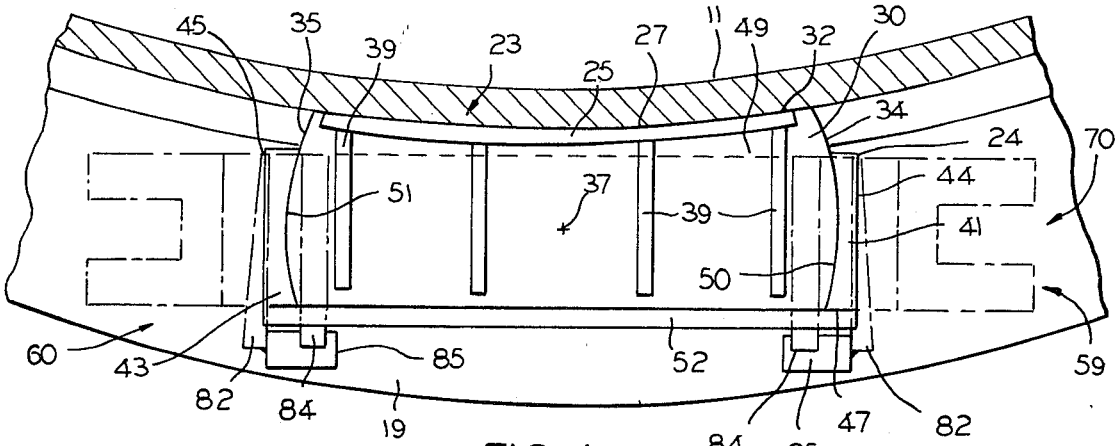
FIG. 4 is a bottom plan view of a portion of the trunnion bracket of FIG. 3.

As seen in FIGS. 3 and 4, the upper support assembly 14 includes a bracket assembly 23 suitably affixed to the shell 11 and engaging the upper surface of a sliding shoe 24. More specifically, the bracket assembly 23 includes a curved mounting plate 25 whose inner surface 27 conforms generally to the outer profile of shell 11 to which it is secured by means of a plurality of bolts or rivets 28 extending through openings formed in plate 25. Affixed to the lower edge of mounting plate 25 is a bracket plate 30 which is generally flat and engages the upper surface 31 of sliding shoe 24. Bracket plate 30 has a curved inner edge 32 which conforms generally to the profile of shell 11 and lateral convex edges 34 and 35 which define arcs of a circle having its radius at the center point 37 of the bracket plate. A plurality of generally triangular strengthening ribs 39 are affixed to the plates 25 and 30.

Sliding shoe 24 includes a relatively flat center plate 26 which is generally rectangular in plan view and upwardly projecting end portions 41 and 43. The outer ends 44 and 45 of end portions 41 and 43 define vertical plane surfaces generally perpendicular to the front and rear edges 47 and 49 of shoe 24. In addition, end portions have inner concave arcuate surfaces 50 and 51, respectively, whose centers of curvature also lie at point 37 so that surfaces 50 and 51 are complimentary to and equispaced relative to convex edges 34 and 35 of bracket plate 30. A thin wear plate 52 may be interposed between the lower surface of sliding shoe 24 and the upper flange 22 of trunnion ring 16.

Retaining gib assemblies 59 and 60 are suitably affixed, such as by welding to the trunnion ring upper flange 22 adjacent the opposite ends of bracket 23 for securing bracket plate 30, shoe 24, and wear plate 52 to flange 22. Each gib assembly is shown in FIGS. 3 and 4 to include a gib block 62 which is generally rectangular in plan view and whose top is defined by a generally horizontal plane surface 63 intersecting with a planar downwardly and outwardly sloping ramp surface 65 to define a tapered end. A longitudinally extending U-shape slot 67 is formed in the tapered end of block 62 and extends in a direction generally normal to the edge 32 of flange 30.

As seen in FIGS. 4, 5 and 6, block 62 further includes a lower, planar surface 68 which engages the top surface 70 of upper flange 22 and a nose portion 71 whose lower surfaces adjacent the bracket plate 30 are generally steplike as defined by a first, generally vertical surface 76; a second surface 77 is inclined downwardly at a slight angle from its outer to its inner edge relative to the upper surface of bracket plate 30 and is spaced therefrom to define a wedge shaped gap; a third surface 79 which is generally horizontal and a fourth surface 80 which is inclined inwardly at a slight angle from its outer to its inner edge relative to the outer surface 44 of shoe end 41 and is spaced therefrom to define a wedge shaped gap.

The gib assembly further includes first and second tapered shims 82 and 84 and platform block 85. First tapered shim 82 has a downwardly, rearwardly inclined upper surface 87 so that spacer 82 corresponds generally to the wedge shaped gap between the surface 77 of gib block 62 and the upper surface of bracket plate 30. Similarly, the second tapered shim 84 has a laterally inwardly sloping side surface 89 which conform generally to the wedge shaped gap defined by side surface 80 of gib block 62 and the outer surface 44 of shoe 24. The platform block 85 is generally cubical in shape and is adapted to mount tapered spacers 82 and 84 in alignment with wedge shaped gaps defined by bracket plate 30, shoe 24 and gib block 62.

When vessel 10 is mounted upon trunnion ring 16, the sliding shoe 24 is disposed between the lower surface of bracket plate 30 and the upper surface 70 of flange 22. As indicated above, a wear plate 53 may be disposed between shoe 24 and flange 22. When the shoe 24 is in this position, the surfaces 50 and 51 will slidably engage the arcuate lateral edges 34 and 35 of bracket plate 30. Gib block 62 is affixed to flange 22 with its nose 71 adjacent bracket assembly 23 and with its planar surface 68 engaging upper flange 22. While gib block 62 may be attached to upper flange 22 in any convenient manner, attachment by welding is preferred.

Platform block 85 is welded to upper flange 22 adjacent the wedge shaped gaps defined by bracket plate 30, shoe 24 and nose 71. First and second tapered spacers 82 and 84 are welded to platform block 85 in the illustrated position such that a slight gap exists between the spacers and the nose 71. This permits movement of bracket plate 30 and sliding shoe 24 relative to gib block 62. When secured in the position shown in FIG. 3, bracket plate 30, sliding shoe 24 and wear shim 52 will be substantially confined except for radial movement as the vessel 10 expands and contracts. Because the shoe surfaces 50 and 51 are complimentary with the edges 34 and 35 of bracket plate 30, self-alignment is achieved between the sliding shoe 24 and the bracket plate 30 should angularity of the bracket plate occur with respect to the sliding shoe as a result of creep caused by radially-uneven vessel expansion and contraction. Movement of bracket plate 30 and sliding shoe 24 with respect to gib block 62 will be accommodated by the tapered shims 82 and 84.

Replacement of the sliding shoe 24 or the wear plate may be easily accomplished by removing the gib assemblies associated with the particular bracket assembly. It will also be appreciated that from time to time it becomes necessary to remove a vessel 10 from the trunnion ring 16 for repair or relining. Replacement of the vessel is accomplished by removing all gib blocks after which the vessel can be lifted out of position. An alternate vessel may then be positioned upon the trunnion ring by interposing a sliding shoe and wear plate between each bracket plate and replacing the gib assemblies.

Figure 7:
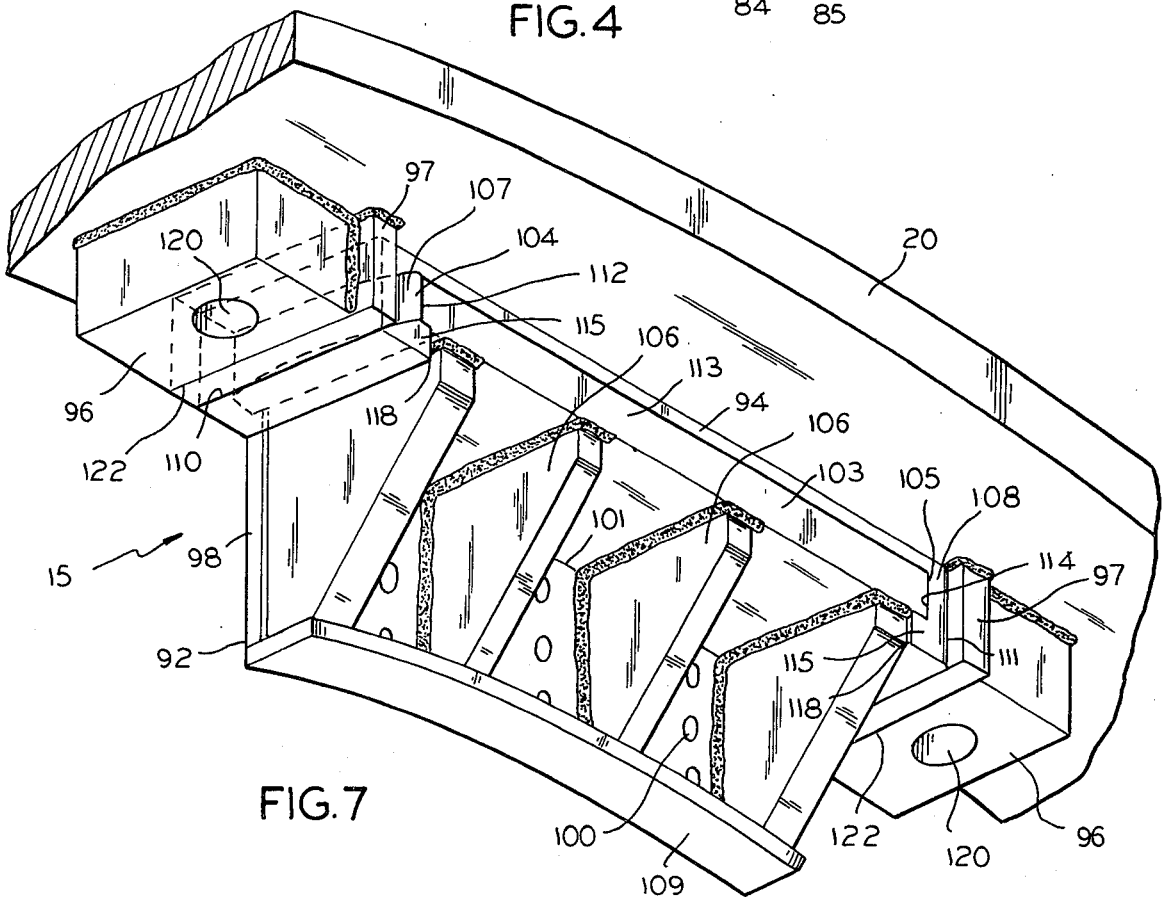
FIG. 7 is a perspective view of the bottom portion of the trunnion bracket according to the preferred embodiment of the invention.
Figure 8:
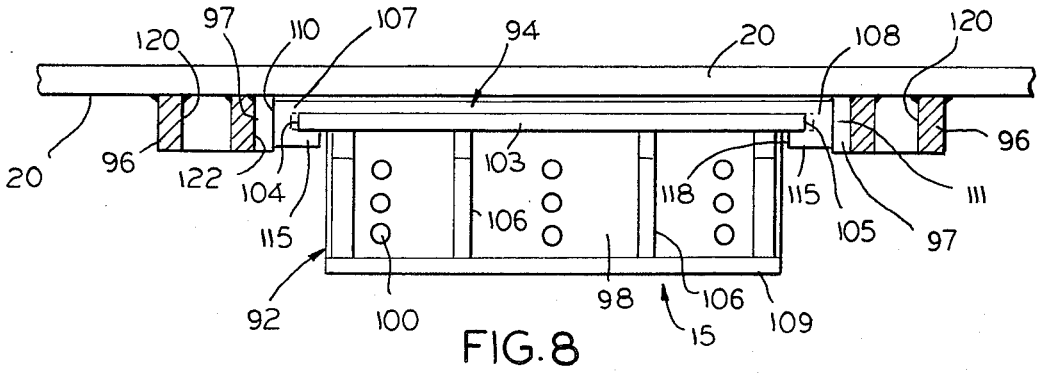
FIG. 8 is a side elevational view, partly in section, of the lower portion of the trunnion bracket illustrated in FIG. 7.

FIGS. 7 and 8 illustrate the lower support assembly 15 in accordance with a preferred embodiment of the invention. Specifically, the lower support assembly 15 includes a lower bracket assembly 92 affixed to the vessel 10, a lower sliding shoe 94 and a pair of retaining blocks 96 affixed to trunnion ring bottom flange 24. Support assembly 15 further includes a pair of spacer bars 97 constructed and arranged to be interposed between the retaining blocks 96 and the outer ends of sliding shoe 94.

The lower bracket assembly 92 is similar to the upper bracket assembly 23 and includes a curved mounting plate 98 adapted to be affixed to the shell of the vessel 10 by bolts or rivets 100 which extend through openings. Affixed to the upper edge 101 of mounting plate 98 and in a normal relation thereto is lower bracket plate 103. The lateral arcuate edges 104 and 105 of lower bracket plate 103 are similar to edges 34 and 35 of upper bracket plate 30. A plurality of generally triangular ribs 106 are affixed to plates 98 and 103 for strengthening the same. A cap plate 109 is affixed to the lower edge of mounting plate 98 and lower ends of ribs 106 for additional rigidity.

Interposed between bracket plate 103 and trunnion ring bottom flange 20 is lower sliding shoe 94. Shoe 94 is generally rectangular in plan view and has at its lateral ends downwardly projecting lips 107 and 108. The outer surfaces 110, 111 of lips 107 and 108 are vertical planes generally perpendicular to the front edge 113 of shoe 94. Each lip has an arcuate inner concave surface 112, 114 conformably contoured to mate with minimal clearances with the associated convex edges 104 and 105 of lower bracket plate 103. At the lower extremity of lips 107, 108 is inwardly projecting tongue 115 having a vertical, generally planar inner edge 118.

In order to permit vessel expansion and contraction, the lower bracket assemblies 92 are spaced vertically from upper bracket assemblies 23 a distance greater than the height of the trunnion ring 16 and the combined thicknesses of lower sliding shoe 94, upper sliding shoe 24 and wear shim 52 so that a slight gap exists between the upper surface of lower shoe 94 and trunnion ring bottom flange 24 as seen in FIG. 8.

Retaining blocks 96 each have a vertical aperture 120 providing additional welding perimeter between the block 96 and bottom flange 24. A generally vertical planar surface 122 is formed on the inner side of each retaining block 96 in an opposed and generally parallel relation to the outer surfaces of lips 107 and 108 of lower shoe 94. The retaining blocks 96 are welded to the trunnion ring bottom flange 24 in spaced relation from and adjacent to the opposite ends of sliding shoe 94.

Each spacer bar 97 includes a rectangular plate mounted between the inner surface 122 of retaining block 96 and the outer surfaces of lips 107 and 108 and welded to bottom flange 24. The width of each spacer bar 97 is slightly less than the distance between the surfaces 122 and 111 to permit slight relative movement between sliding shoe 94 and retaining blocks 96 as the vessel shell expands and contracts during vessel operation.

While the preferred embodiment of the invention has been illustrated and described, it is not intended to be limited thereby but only by the scope of the appended claims.

I claim:

1. A metallurgical vessel including:

a trunnion support at least partially surrounding said vessel, a plurality of bracket means affixed to said vessel in spaced-apart relation for supporting said vessel on said trunnion support, said bracket means having a pair of arcuate lateral edges extending generally away from said vessel, retainer means for each bracket means and including a pair of gib blocks affixed to said trunnion support adjacent each lateral edge of said bracket means and being positioned to prevent displacement of said bracket means away from said trunnion support, said retainer means also including first and second portions disposed respectively between said gib blocks and the lateral edges of said bracket means and each portion having a surface complimentary to and disposed adjacent one of the arcuate lateral edges on said bracket means to permit angular reorientation of said bracket means relative to said gib blocks should said vessel become distorted in operation, said retainer means also including a third portion interconnecting said first and second portions and disposed between said bracket means and said trunnion support and being slidably engaged by the bracket means.

2. The vessel set forth in claim 1 and including shim means disposed between each gib block and said first and second portions of said retainer means.

3. The vessel set forth in claim 2 wherein said bracket means has a first surface presented toward said trunnion support and a second surface facing away therefrom, the first surface of said bracket means and the adjacent surface of said retainer means are relatively planar and in sliding engagement, the first and second portions of said retainer means are integral with said connecting portion and extend upwardly therefrom, said first and second portions each having second and third generally planar surfaces, each of said gib blocks having first and second planar surfaces disposed respectively adjacent the planar surfaces of said first and second portions and being oriented at an angle relative thereto, and wedge shaped shim means disposed between the planar surfaces of said first and second portions and said gib blocks.

4. The vessel set forth in claim 3 and further including means for affixing each of said shim means to said trunnion support to retain the same between said retainer means and said gib block means.

5. The vessel set forth in claims 2, 3 or 4 wherein the arcuate surfaces on said first and second portions and the adjacent arcuate surfaces on the lateral edges of said bracket means each define an arc of a circle.

6. The vessel set forth in claims 2, 3 or 4 wherein said trunnion support includes upper and lower support surfaces, there being a plurality of brackets disposed adjacent each of said upper and lower surfaces for supporting said vessel in upright and tilted positions, and retainer means being associated with each of said upper and lower bracket means.

7. Means for supporting a metallurgical vessel including:

a trunnion support constructed and arranged to at least partially surround said vessel, including:

a plurality of bracket means affixed to said vessel in spaced-apart relation for supporting said vessel on said trunnion support, each bracket means having an arcuate surface means extending generally away from said vessel, retainer means for each bracket means and including gib means affixed to said trunnion support adjacent to and having a portion constructed and arranged to prevent displacement of said bracket means away from said trunnion support, said retainer means also including second means disposed between said gib means and the arcuate surface means of said bracket means and having an arcuate surface means complimentary to and disposed adjacent the arcuate surface means of said bracket means to permit angular reorientation of said bracket means relative to said first means should said vessel become distored in operation.

8. The combination set forth in claim 7 wherein said arcuate surface means comprises a pair of arcuate surfaces, said second means including first and second portions disposed respectively between the arcuate surfaces of said bracket means and said gib means, said complimentary arcuate surface means comprises arcuate surfaces formed on each of said portions.

9. The combination set forth in claim 8 wherein each said arcuate surfaces define a circular arc.

10. The combination set forth in claims 10 or 11 wherein said second means includes a third portion connecting said first and second portions and having a surface formed thereon, said bracket includes a first surface adjacent said trunnion support and a second surface facing away therefrom, the first surface of said bracket means and the surface of said second means being relatively planar and in sliding engagement, the first and second portions of said second means are integral with said connecting portion and extend upwardly therefrom, said first and second portions each having second and third generally planar surfaces, each of said gib means having first and second planar surfaces disposed respectively adjacent the planar surfaces of said first and second portions and being oriented at an angle relative thereto, and wedge shaped shim means disposed between the planar surfaces of said first and second portions and said gib means.

11. The combination set forth in claims 8 or 9 wherein each said second means includes a third portion disposed between said bracket means and said trunnion support and interconnecting said first and second portions, said bracket means slidably engaging said third portion.

* * * * *